US005941810A

United States Patent [19]

Gay

[11] Patent Number: 5,941,810

[45] Date of Patent: Aug. 24, 1999

[54] CENTRIFUGAL SEPARATOR HAVING A PLANETARY HUB

[75] Inventor: Daniel Gay, Le Poinconnet, France

[73] Assignee: Guinard Centrifugation, Saint Cloud, France

[21] Appl. No.: 08/832,326

[22] Filed: Mar. 26, 1997

[30] Foreign Application Priority Data

Mar. 29, 1996 [FR] France ..... 96 03947

[51] Int. Cl.[6] ..... B04B 9/08

[52] U.S. Cl. ..... 494/53; 494/84; 475/335; 475/339

[58] Field of Search ..... 494/7–9, 50–53, 494/84; 475/335, 339

[56] References Cited

U.S. PATENT DOCUMENTS

| | | | |
|---|---|---|---|
| 2,867,378 | 1/1959 | Harlow | 494/53 |
| 3,187,997 | 6/1965 | Gooch | 494/84 |
| 3,481,222 | 12/1969 | Baron | 475/335 |
| 5,403,260 | 4/1995 | Hensley | 494/8 |
| 5,472,387 | 12/1995 | Kamlukin | 475/339 |

FOREIGN PATENT DOCUMENTS

| | | | |
|---|---|---|---|
| 271898 | 6/1988 | European Pat. Off. . | |
| 2610058 | 7/1988 | France . | |
| 9409109U1 | 11/1995 | Germany . | |
| 1191868 | 5/1970 | United Kingdom | 475/339 |
| 2016306 | 9/1979 | United Kingdom . | |
| 9423223 | 10/1994 | WIPO . | |

*Primary Examiner*—Charles E. Cooley
*Attorney, Agent, or Firm*—Knobbe Martens Olson & Bear, L.L.P.

[57] ABSTRACT

Centrifugal separator comprising a drum (8) driven in rotation by a main electric motor (1), via a machine pulley (5), a first drive shaft (6) and a reducer (7), a screw (17), surrounded by the drum and driven in rotation by a secondary electric motor (9), via a second and third drive shaft (10, 16), coaxial with the first shaft (6), wherein a module is mounted between the secondary electric motor (9) and the reducer (7) comprising a casing (11), a sleeve (13) and a planetary hub (15), the hub passing through the casing and comprising a first planetary gear (25) rigidly attached in rotation to the hub, the sleeve (13) being disposed around a part of the hub (15) and comprising, rigidly attached in rotation, a second planetary gear (26), at least one axle (27) being mounted parallel to the hub (15) and comprising two satellite gears (29,30,31,32), rigidly attached in rotation to the axle, which engage with the first planetary gear (25) and the secondary planetary gear (26) respectively, at least one of the said axles being mounted so as to turn on the casing (11).

8 Claims, 2 Drawing Sheets

CENTRIFUGAL SEPARATOR HAVING A PLANETARY HUB

CROSS REFERENCE TO RELATED APPLICATIONS

This application claims priority from French patent application number 96 03947 filed Mar. 29, 1996.

The invention concerns a High Precision Centrifugal Separator with a screw conveyor.

A centrifugal separator comprises a screw conveyor contained in a drum, more particularly a cylindro-conical drum, with the same main axis as the screw. The drum is driven in rotation by a main electric motor at a speed different from the screw which is driven in rotation by a secondary electric motor and by a reducer.

If the speed of rotation of the drum is called $V_B$ the speed of rotation of the secondary motor is called $V_S$ and the reduction ratio of the reducer is called k, the speed of rotation of the screw is given by the formula $$V_{vis} = V_B + \left(\frac{V_B - V_S}{k}\right), \tag{1}$$

i.e. a relative speed of rotation of the screw with respect to the drum of $$V_R = \frac{V_B - V_S}{k} \tag{2}$$

The user of the centrifugal separator will wish to be able to apply an increasing torque to the centrifugal separator to compress the solid part decanted to the maximum and thus to increase the dryness of this part.

The speeds required of the drum and the screw are also very high. These high speeds have brought about an increase in the slip of asynchronous motors, and similarly an increase in the imprecision of the relative speed $V_R$, in particular for low values of $V_R$, such as 2 to 3 rpm used for compacting the solid.

It will be seen from equation (2) that in order to obtain greater precision for the speed $V_R$, it is necessary to increase k.

Now, the usual values of k are situated between 25 and 87 in the case of a single stage. It would be desirable to have k ratios which are greater than these values, in particular of the order of twice as great, while having available a less complex drive system, taking up less space and being less costly.

One would have thought that, in order to achieve this increase in k, that it would simply be necessary to mount a single reducer with a ratio of 2 in series with the k reducer. However, this apparently simply solution is not suitable, since although it is true that is enables the precision of the relative speed to be increased, it causes on the other hand the torque to be divided by two and, moreover, the speed to be multiplied by two, which is not acceptable, by reason of the permitted speed for secondary motors as well as by reason of the fact that the recycled power remains constant.

Other solutions have been proposed in the form of complex assemblies which are both bulky and costly.

A centrifugal separator is already known from GB-2 016 306 comprising a drum driven in rotation by a main electric motor, via a machine pulley, a first drive shaft and a first epicyclic reducer, a screw, surrounded by the drum and driven in rotation by a secondary electric motor via a second drive shaft which is coaxial with the first drive shaft, and a second reducer.

In this document GB-2 016 306, the torque between the screw and the drum is measured by measuring the strength of the current through the secondary motor and the relative speed is adjusted by a frequency variator, by causing the second drive shaft to rotate.

If the secondary motor has a fixed speed, it is necessary to adjust the speed of the casing of the second reducer to obtain the desired relative speed. If the secondary motor is controlled by a regulating system, it is necessary to make use of costly systems such as a direct current motor and a corresponding variator or a mechanical motor-driven variator.

In either case, the system according to the patent GB-2 016 306 requires an adjustment to the speed of the casing. In addition, variations in the relative speed are limited on account of the minimum ratio of the cyclos of 1/11 for the small reducer and of 1/25 for the main reducer, that is a minimum of 1/275.

Finally, in the case of a variation in the speed of the shaft with a motor driven frequency variator, it is absolutely necessary for the speed of the shaft to be greater than the speed of the casing in order to drive. In the contrary case, the variator disconnects. In follows that the shaft turns at high speeds (3000 to 6000 rpm) which is detrimental.

From the document FR-A-2 610 058 a module is known comprising a casing, a sleeve and a planetary gear hub, the hub passing through the casing and comprising a first planetary gear rigidly attached in rotation to the hub, the sleeve being disposed around part of the hub and comprising, rigidly attached in rotation, a second planetary gear, an axle being mounted parallel to the hub and comprising two satellite gears which engage with the first planetary gear and second planetary gear respectively. In addition, a satellite gear carrier is provided on which are mounted the axles of the satellite gears so that they can rotate, the satellite gear carrier being maintained, rigidly attached in rotation by a reaction arm acting on the end of the shaft of the satellite gear carrier, the axles of the satellite gears not being rigidly attached to the casing of the device. To replace the second reducer of the device described in GB-2 016 306 by the module described in FR-A-2 610 058, would make the system costly and complex.

In addition, to replace the second reducer of GB-2 016 306 by the module of FR-A-2 610 058 would bring about the following disadvantages. Since the input shaft is driven by the satellite gears and the secondary motor, the latter being fixed, the relative speed would then be nil. In addition, if the motor is made to revolve in one direction or the other, the first planetary gear will shift the speeds between the satellite gears and the input shaft, resulting in a positive or negative relative speed. It follows that the relative speed only depends on the speed of the motor which is always driving. It follows that the relative speed cannot vary in relation to requirements, in particular in relation to the degree of dryness of the solid to be centrifuged. In order to vary this relative speed, it is necessary to add a motor-driven reducer to the assembly, which makes the system even more complex. The installed power is low on account of the fact that the reduction ratio is of the order of 1/200, i.e. for $V_R$=5 a motor speed of 1000 rpm, which is low. The system is thus costly if it is desired to obtain a high torque. In addition, it is difficult to position a bearing on the end of the block due to the diameter being too large and due to difficulties in precisely centring the rotor on the drum, taking into account the large number of parts packed together.

SUMMARY OF THE INVENTION

The invention concerns a centrifugal separator with a screw conveyor which makes it possible to obtain a better precision over the relative speed with a reduction in the installed power of the motor, this device being however in the form of a simple assembly which is economical and takes up little space.

According to the invention, a Redex module is provided, mounted between the secondary motor and the epicyclic reducer.

This Redex module (trade name) which can be obtained from the Redex Company 45210 FERRIERES, FRANCE, is described in detail in the REDEX company's catalogue entitled "Differentials and Reducers-Series Module SR 50 to 280 000 Nm".

This combination of a cyclo-reducer, a centrifuge and a Redex module thus enables the overall reduction ratio to be increased while maintaining the applied torque between the screw and the drum and while reducing the recycled power. This result is obtained by simply adding a Redex module. The final assembly is simple and takes up little space and hence is not costly.

Moreover, the Redex module is easily added to the existing module and may be manufactured on a large scale in an economical manner. It is easy to override without dismantling in order to obtain relative speeds which are doubled when the machine is multi-purpose and can process several products.

This Redex module is constructed according to the principle involving a system with a train of epicyclic gears with multiple satellite gears, and a description of this is given below.

According to one advantageous embodiment, the Redex module is mounted directly at the output from the secondary drive motor, coaxially to the drive shaft of the screw, a shaft which is driven in rotation by the secondary drive motor and upstream from the machine pulley which is mounted rigidly on the drive shaft of the outer casing of the main reducer, rigidly attached in rotation to the cylindro-conical drum, and which is driven by the main motor via a first pulley coaxial with the shaft coming from the main motor and by a belt transmitting the movement of the first coaxial pulley to the machine pulley.

This embodiment is particularly small and easy to construct. Moreover, it allows easy access to the Redex module and enables it to be replaced by a Redex module having different parameters according to the requirements relating to each application for the centrifuge.

According to an improvement of the invention, the planetary sleeve of the Redex module is mounted rigidly in rotation to the machine pulley which transmits the torque of the main motor to the outer casing of the reducer, itself mounted rigidly in rotation to the drum, while the hub of the Redex module is mounted rigidly in rotation to the drive shaft of the screw and the outer casing of the Redex module is mounted rigidly to the output shaft of the main motor.

The speed of rotation of the hub is then exactly proportional to the speed of rotation of the casing, in a ratio K. The same relationship is thus obtained, as regards the relationship between these two speeds of rotation, as in the case where another single reducer is mounted in series with the reducer, without however having to suffer the disadvantages associated with the use of a single reducer (increase in speed without reduction in power).

If the sleeve is not locked and is driven for example by the drive pulley, the relationship between the speeds of rotation will be certainly more complex, but the precision over the relative drum-screw speed will however be improved in relation to devices of the prior art, whilst also reducing the power applied.

According to an improvement to the invention, it is also possible to provide detachable means for fixing the sleeve for example by sliding, designed to attach the sleeve rigidly in rotation to the outer casing of the Redex module in a releasable manner.

By virtue of this rigid attachment in rotation, it is thus possible to override the Redex module entirely and thus to have available a centrifuge with a single reducer, which may be useful in cases where is desired to have available a high relative speed between the drum and the screw.

Table 1 below shows the various ranges of variation for $V_R$ and the power necessary for various values of the ratio $k_2$ of the Redex module, compared with the case where a Redex module is not used.

TABLE 1

| k1 cyclo | k2 Redex | k total $k_1 \times k_2$ | $V_R$ rpm | Power kW |
|---|---|---|---|---|
| 71 | . . . | 71 | 0 to 28 | 17.8 |
| 71 | 2 | 144 | 0 to 16 | 7.8 |
| 71 | 2.72 | 193 | 0 to 12 | 5.2 |
| 71 | 3.33 | 272 | 0 to 8 | 3 |

BRIEF DESCRIPTION OF THE DRAWINGS

In the accompanying drawings, given solely by way of example.

DETAILED DESCRIPTION

Figure 1:
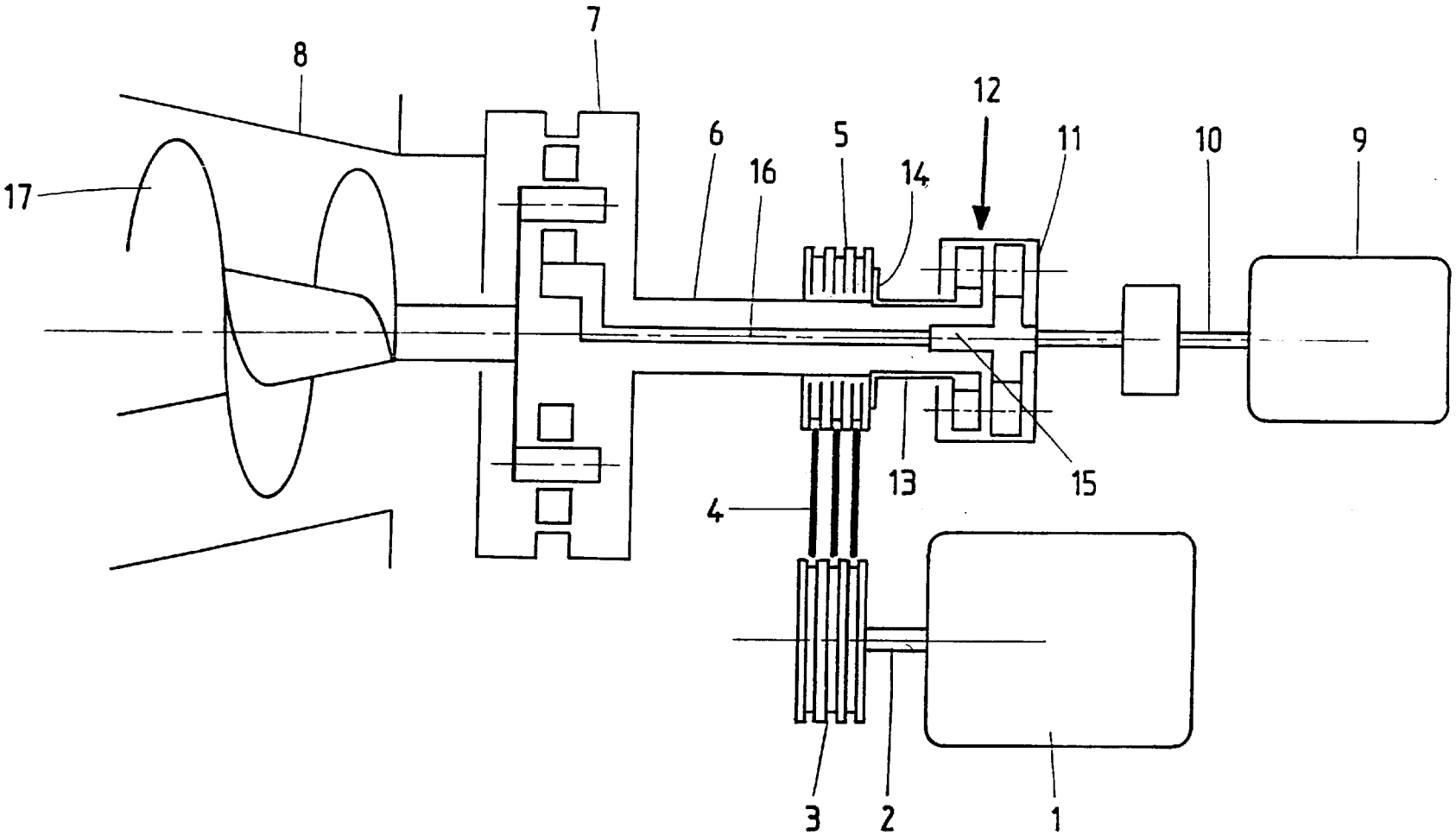
FIG. 1 shows a diagram of the centrifuge according to the invention.

In FIG. 1, the centrifuge comprises a first drive motor 1 from which a first drive shaft 2 emerges which transmits the drive torque of the motor to a machine pulley 3, to which it is rigidly attached in rotation.

This machine pulley 3 transmits the movement to a second main machine pulley 5 by means of a transmission belt 4. The main machine pulley 5 is keyed to a first primary drive shaft 6. This primary shaft 6 is rigidly attached in rotation to the outer ring gear of a cyclo-reducer 7 on which is mounted the cylindro-conical drum 8 of the separator, rigidly attached in rotation.

The centrifugal separator comprises a second secondary motor 9 from which a second drive shaft 10 emerges which is mounted rigidly attached in rotation to the outer casing 11 of the Redex module 12.

The sleeve 13 of the Redex module is mounted rigidly in rotation to the main machine pulley 5 by appropriate means of attachment 14 (screw).

Finally, the hub 15 of the Redex module is mounted rigidly attached in rotation to a third drive shaft 16 which is mounted rigidly attached in rotation to the screw 17 of the separator.

The speed of rotation of the main motor may be between 1000 and 2000 rpm and the speed of rotation of the secondary motor may be between 2000 and 4000 rpm, the torques applied being between 100 and 1000 Nm and between 20 and 200 Nm respectively.

Figure 2:
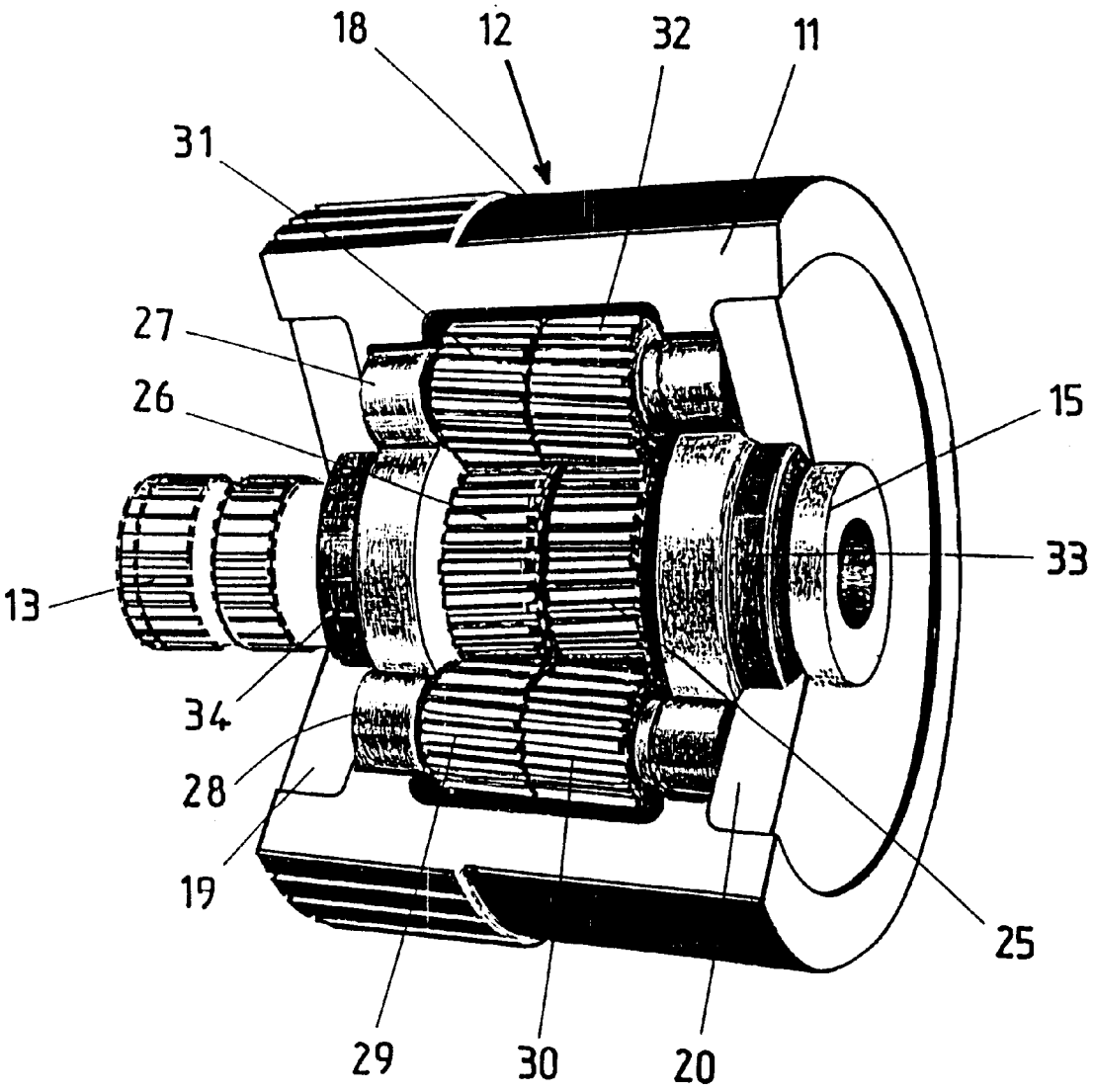
FIG. 2 is a perspective view of a Redex module used in the assembly.

FIG. 2 is a perspective view of a Redex module 12.

This Redex module 12 consists of an outer casing 11, made in the form of a water-tight monobloc cast iron cylinder and two cast iron side covers 19, 20, which close off the casing laterally.

The outer casing 11 is traversed by a cylindrical hub 15 which extends coaxially to the axis of the cylinder 18 and which comprises a first section extending outwards from the casing 11, on the outside of the cover 20, a second section extending to the inside of the casing 11, on the side of the cover 20, over approximately half the axial length of the cylinder 18, a third section extending to the inside of the casing 11, on the side of the cover 19, over the remainder of the axial length of the cylinder 18 and a fourth section extending outwards from the casing 11, on the outside of the cover 19. The hub 15 is attached to the casing 11 by means of a fixing ring 33 so as to be able to turn about its axis.

A first planetary gear 25 is disposed about a part of the second section, rigidly attached in rotation to the hub 15.

A sleeve 13 is disposed around the third and fourth sections of the hub 15 and comprises a second planetary gear 26 disposed around a part of the third section, rigidly attached in rotation to the sleeve 13. The sleeve 13 is attached to the casing 11 by a fixing ring 34, so as to be able to turn about its axis.

Two axles 27, 28, parallel to the axis of the cylinder 18, are mounted, so as to turn, on the outer casing 11 of the Redex module. The satellite gears 29, 30, 31, 32 are mounted coaxially on these axles, covering and rigidly attached in rotation with these axles 27, 28.

The satellite gears 29 and 31 have the form of a toothed wheel and each of these engages with the toothed wheel of the second planetary gear 26 while the satellite gears 30 and 32 also have the form of a toothed wheel and each engages with the toothed wheel of the first planetary gear 25.

The first drive motor 1 turns a drive shaft 2 which results in rotation of the first main pulley 3 and second main pulley 5. Rotation of the second main pulley 5 causes rotation of the primary drive shaft 6 which is affixed to the outer casing of the cyclo-reducer 7. Rotation of the exterior casing of the cyclo-reducer 7 causes rotation of the conical drum 8. Rotation of the second main machine pulley 5 also causes rotation of the sleeve 13 and planetary gear 26 of the module 12. Thus, applying power to the first drive motor 1 results in rotation of the conical drum 8, sleeve 13 and planetary gear 26.

The second drive motor 9 is affixed to the outer casing 11 and cylindrical hub 15 of the module 12. Rotation of the cylindrical hub 15 results in rotation of the drive shaft 16 and screw 17, which passes through the reducer 7. Thus, applying power to the second motor 9 causes rotation of the outer casing 11, cylindrical hub 15, drive shaft 16 and screw 17.

By varying the speeds of the first motor 1 and second motor 9, a user can alter the rotational speeds of the drum 8 and screw 17.

I claim:

1. A centrifugal separator having a drum, a screw and first and second motors, comprising:

a module having an outer casing, a planetary hub passing therethrough, and a sleeve rotatable around the planetary hub, wherein the module is connected via the sleeve to the first motor so that activation of said first motor results in rotation of said sleeve, and wherein the module is connected via the planetary hub to the second motor so that activation of the second motor results in activation of the planetary hub, wherein the module further comprises a first planetary gear rigidly attached in rotation to the hub and a second planetary gear rigidly attached in rotation to the sleeve;

an axle mounted to the outer casing and arranged parallel to the planetary hub;

first and second satellite gears rigidly attached in rotation to the axle, wherein the first satellite gear engages with the first planetary gear and the second satellite gear engages with the second planetary gear;

a first drive shaft connected at one end to the sleeve and at another end to an exterior casing of a reducer, wherein the exterior casing is fixedly attached to the drum;

a second drive shaft affixing the planetary hub to the second motor; and a third drive shaft connecting the planetary hub to the screw via the reducer.

2. The centrifugal separator according to claim 1, wherein the first motor turns a pulley connected to the first drive shaft, and the module is mounted between the second motor and the pulley.

3. The centrifugal separator according to claim 2, wherein the module has a reduction ratio of between 2 and 8.

4. The centrifugal separator according to claim 3 wherein the sleeve is rigidly attached in rotation to the pulley while the outer casing is rigidly attached in rotation to the second drive shaft and the planetary hub is rigidly attached in rotation to the third drive shaft.

5. The centrifugal separator according to claim 2, wherein the sleeve is rigidly attached in rotation to the pulley while the outer casing is rigidly attached in rotation to the second drive shaft, and the planetary hub is rigidly attached in rotation to the third drive shaft.

6. The centrifugal separator according to claim 1, wherein the module has a reduction ratio of between 2 and 8.

7. The centrifugal separator according to claim 6, wherein the sleeve is rotated by the first motor while the outer casing is rigidly attached in rotation to the second drive shaft and the planetary hub is rigidly attached in rotation to the third drive shaft.

8. The centrifugal separator according to claim 1, wherein the sleeve is rotated by the first motor while the outer casing is rigidly attached in rotation to the second drive shaft, and the planetary hub is rigidly attached in rotation to the third drive shaft.

* * * * *